US005235925A

United States Patent [19]

Farrier

[11] Patent Number: 5,235,925

[45] Date of Patent: Aug. 17, 1993

[54] RETRACTABLE CONNECTING BEAM FOR TRIMARANS

[76] Inventor: Ian L. Farrier, 1108 Paseo Entrada, Chula Vista, Calif. 92010

[21] Appl. No.: 907,052

[22] Filed: Jul. 1, 1992

[51] Int. Cl.[5] ..... B63B 1/14

[52] U.S. Cl. ..... 114/61; 114/123

[58] Field of Search ..... 114/123, 284, 61

[56] References Cited

U.S. PATENT DOCUMENTS

| | | | |
|---|---|---|---|
| 1,709,219 | 4/1929 | Hille | 114/123 |
| 3,064,370 | 11/1962 | La Fleur | 114/123 |
| 3,937,166 | 2/1976 | Lindsay | 114/123 |
| 3,954,077 | 5/1976 | Piat-Marchand | 114/123 |
| 3,960,102 | 6/1976 | Davy | 114/123 |
| 4,457,248 | 7/1984 | Thurston | 114/123 |
| 4,474,128 | 10/1984 | Wallach | 114/123 |
| 5,038,697 | 8/1991 | Farrier | 114/61 |

*Primary Examiner*—Sherman Basinger
*Assistant Examiner*—Thomas J. Brahan
*Attorney, Agent, or Firm*—Charles C. Logan, II

[57] ABSTRACT

A retractable connecting beam for a trimaran that allows the stabilizing floats to be retracted in against the center hull for trailering or marina docking. The outer end of the connecting beam is pivotally secured to the top surface of the stabilizing float so that as the connecting beam is retracted, the stabilizing float will remain vertical as it is drawn into its retracted position adjacent the center hull of the trimaran. The inner end of the connecting beam is oriented generally upright thus avoiding restricting access along the center hull deck of the trimaran.

5 Claims, 2 Drawing Sheets

RETRACTABLE CONNECTING BEAM FOR TRIMARANS

BACKGROUND OF THE INVENTION

The invention relates to multi-hull boats and more specifically ones having retractable connecting beams that allow the stabilizing floats to be folded alongside the center hull for trailering or docking in a standard marina.

Wide beam has always been a problem with trimarans, and the Float Connection Assemblies as described in the related patents have solved this with a simple and effective method of retracting the stabilizing floats of a trimaran to be alongside the center hull for trailering, or for docking in a standard marina slip. This system is now widely used.

However, a problem with marina docking has been underwater marine growth on the retracted floats' sides. This can be overcome by varying the folded geometry of the Float Connection Assemblies as in the related patents, but there is still a need to use anti-fouling paint higher on the float sides than is preferred and the beams extending above and across the center hull deck tend to obstruct access along the deck when docked.

Other float retraction systems, such as the 'swing wing' system allow retraction by the floats by pivoting aft about vertical pivot shafts on both the floats and the center hull. This allows a normal level of anti-fouling on the float. However, the structural problems with this system are not easy to overcome, plus the overall length of the boat is increased and may necessitate a larger, more expensive dock.

An early example of a trimaran that had retractable connecting beams is illustrated in the Lindsay U.S. Pat. No. 3,937,166. One of its major disadvantages was the fact the stabilizing floats in their retracted position allowed for underwater marine growth on the retracted floats sides. Also the inner ends of the connecting beam in their retracted position extended above and across the center hull deck tending to obstruct access along the deck when docked.

The Thurston U.S. Pat. No. 4,457,248 illustrates the use of retracted connecting beams in various embodiments. His structure in some embodiments had his beams extending above and across the center deck hull thereby obstructing access along the deck when docked. His structure also allows for excessive underwater marine growth on the retracted float sides when in their retracted position.

The Thurston U.S. Pat. No. 4,878,447 also has structure which exhibits the same characteristics as the two previously discussed patents.

It is an object of the invention to provide a novel retractable connecting beam for a trimaran that allows the stabilizing floats to be retracted in against the center hull for trailering or marina docking while maintaining a substantially unobstructed access along the deck of the center hull.

It is also an object of the invention to provide a novel retractable connecting beam for trimarans that allows the stabilizing float to be maintained substantially vertical while traveling from its extended position to its retracted position thereby preventing marine growth along the lateral sides of the stabilizing float.

It is another object of the invention to provide a novel retractable connecting beam for a trimaran that can be easily manufactured and installed.

SUMMARY OF THE INVENTION

The novel retractable connecting beam for trimarans has its outer end pivotally connected to the top surface of the stabilizing float. As the inner end of the connecting beam is lifted upwardly and pivoted to a substantially upright position, the stabilizing float is maintained in a vertical orientation while being drawn inwardly to a position adjacent the main or center hull of the trimaran. There is an upper folding strut and a lower folding strut whose inner and outer ends are pivotally connected respectively to the center hull and the connecting beam. A float tie strut has its inner end pivotally connected to the lower folding strut and its outer end pivotally connected to the stabilizing float.

The retracted position is used for trailering the trimaran or for docking it in a standard marina slip. When in the marina slip, only the bottom end of the stabilizing float remains in the water thereby minimizing the amount of underwater marine growth that will form thereon. This eliminates the need for using anti-fouling paint higher on the float side than is preferred. Prior art systems show that the stabilizing floats in their retracted position had an excessive amount of their lateral sides in constant contact with the water surface. It was this situation that produced the unwanted marine growth on the exposed lateral surfaces of the stabilizing float.

In the retracted position, the inner ends of the connecting beams are oriented substantially vertical and thus avoid restricting access along the center hull deck. This is highly important when the trimaran is docked in the marina slip.

DESCRIPTION OF THE PREFERRED EMBODIMENT

Figure 1:
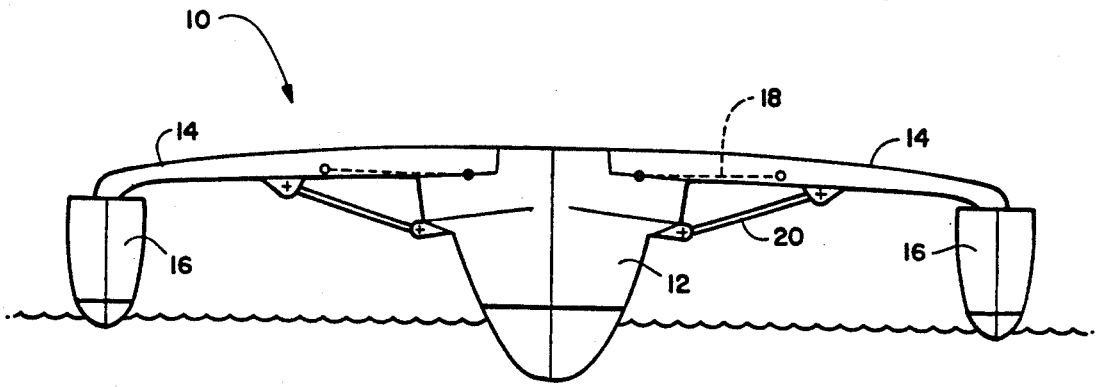
PRIOR ART FIGURE 1
FIG. 1 is a front elevation view of a trimaran having a retractable connecting beam such as described in the prior art U.S. Pat. No. 3,937,166 with the floats in the extended position.

The novel retractable connecting beam for trimarans will now be described by referring to FIGS. 1–4 of the drawings. A prior art design for retractable connecting beams is illustrated in FIG. 1 where they are shown in their deployed position. The trimaran 10 has a center hull 12, a pair of connecting beams 14 and a pair of stabilizing floats 16. The float connecting assembly illustrated consists of upper pivoting guide frames 18 and lower pivoting guide frames 20. The float connection assembly will allow the stabilizing floats 16 to be retracted inwardly to lie along side the trimarans center hull 12.

Figure 2:
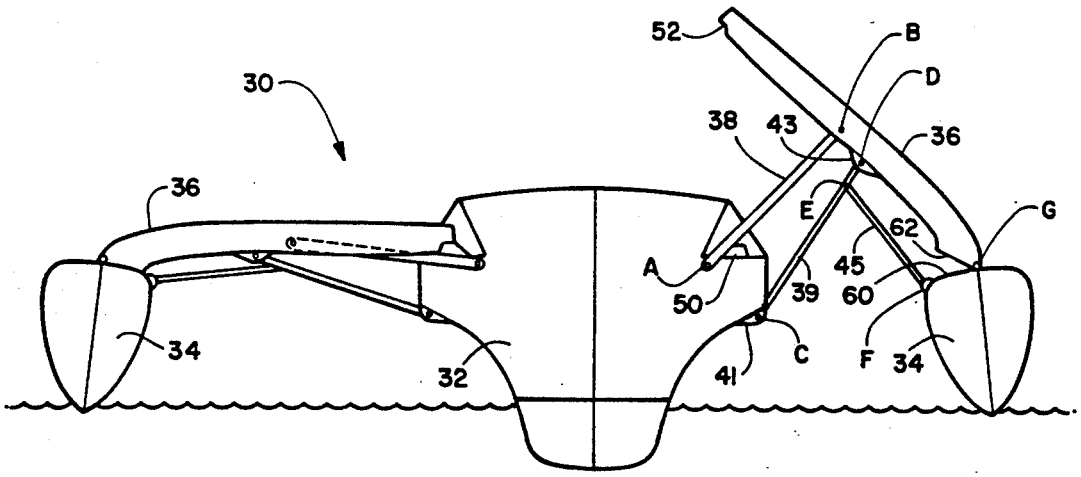
FIG. 2 is a front elevation view of applicant's novel retractable connecting beam in its partially retracted position.
Figure 3:
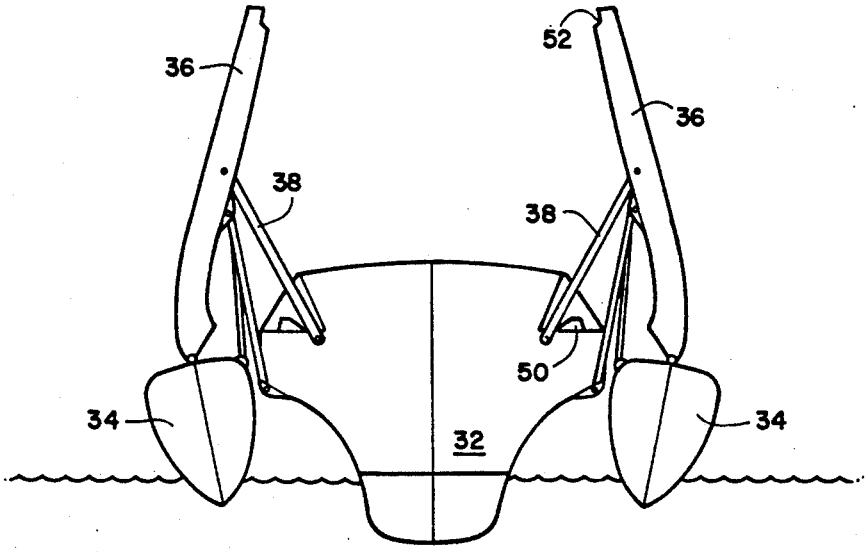
FIG. 3 is a front elevation view of the novel retractable connecting beam showing the stabilizing floats in their fully retracted position.
Figure 4:
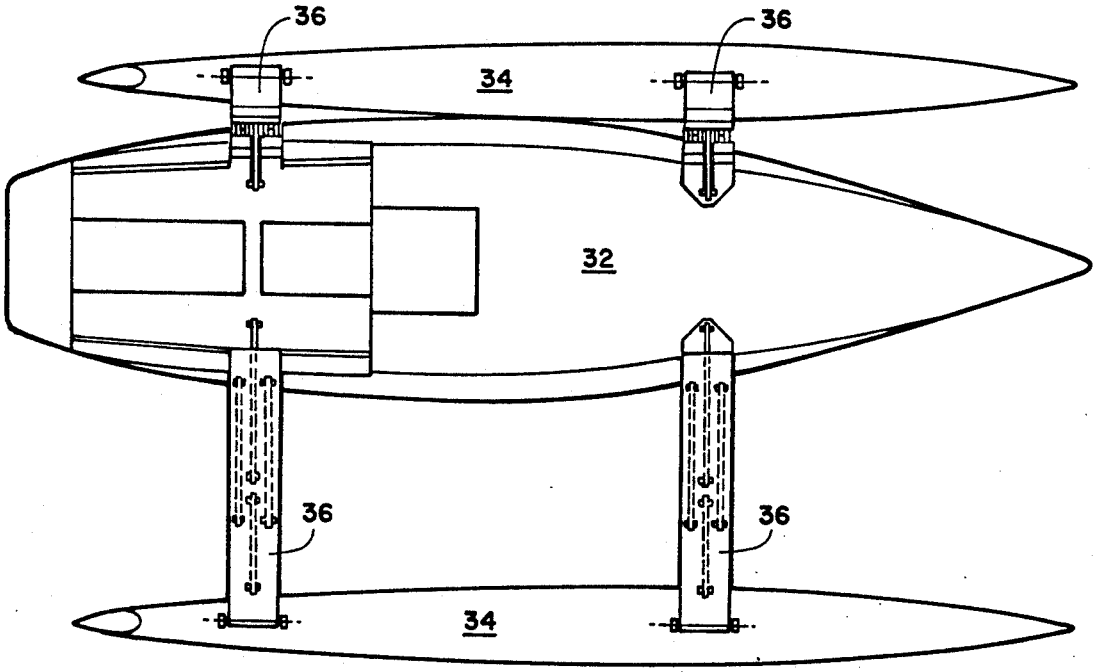
FIG. 4 is a top plan view showing one of the connecting beams in its retracted position and the other connecting beam in its fully extended position.

The novel retractable connecting beams for a trimaran is illustrated in FIGS. 2–4 where they are attached to a trimaran 30. Trimaran 30 has an elongated center or main hull 32 having a longitudinally extending axis. Stabilizing floats 34 have a longitudinally extending axis that is oriented substantially parallel to the longitudinal axis of the center hull 32. Connecting beams 36 are made of a substantially rigid unbendable structure. Upper folding struts 38 have their inner ends pivotally mounted at point A and their outer ends pivotally mounted at point B. Lower folding struts 39 have their inner ends pivotally mounted about point C on brackets 41 and their outer ends pivotally mounted about point D on brackets 43. Float tie struts 45 have their inner ends pivoted about point E and their outer ends pivoted about point F. Stabilizing floats 34 are connected by a pivot pin at point G to the outer end of connecting beams 36.

The upper and lower folding struts function to allow the stabilizing floats 34 to be positioned on the water with the connecting beams 36 in a substantially horizontal orientation and also allow the connecting beams 36 to be retracted to a first upright position that would be used when trailering or docking the multi-hull boat. The float tie strut functions to pull the inner lateral surface of the stabilizing floats 34 toward the main hull 32 when the connecting beam is retracted to the position illustrated in FIG. 3.

Stop blocks 50 on the main hull are detachably engaged by recesses 52 on the inner ends of connecting beams 36 for positively positioning connecting beams 36 in their horizontal position.

The concave surface 62 of connecting beams 36 mate with the convex top surface 60 of stabilizing floats 34.

In FIG. 4, it can be seen that the trimaran may have both fore and aft connecting beams 36 each having substantially identical struts for retracting them and the stabilizing floats.

All of the above have been given by way of illustrative example, it will, of course, be realized that many modifications to construction detail and design may be made to the described embodiment and that the features of the invention may be utilized on other multi-hulled boats by persons skilled in the art without departing from the broad scope and ambit of the invention as defined in the appended claims.

What is claimed is:

1. A multi-hull boat comprising:

an elongated main hull having lateral sides and a longitudinally extending axis;

an elongated first stabilizing float having a top surface, an inner lateral side, and a longitudinally extending axis;

the longitudinal axis of said first float is laterally spaced from the longitudinal axis of said center hull and they are oriented substantially parallel to each other;

a first elongated connecting beam having an inner end and an outer end, said first connecting beam being a substantially rigid unbendable structure;

the outer end of said first connecting beam being pivotally connected to said first stabilizing float;

a first elongated upper folding strut having an inner end and an outer end;

the inner end of said first upper folding strut being pivotally connected to said main hull and its outer end being pivotally connected to said first connecting beam at a predetermined point intermediate its opposite ends;

a first elongated lower folding strut having an inner end and an outer end, the inner end of said first lower folding strut being pivotally connected to one of the lateral sides of said main hull and its outer end being pivotally connected to said first connecting beam at a predetermined point intermediate its opposite ends;

said upper and lower folding struts functioning to allow said first stabilizing float to be positioned on the water with said first connecting beam in a substantially horizontal orientation and also allow said first connecting beam to be retracted to a first upright position to be used when trailering or docking said multi-hull boat; and means for pulling the inner lateral surface of said first stabilizing float toward said main hull when said first connecting beam is retracted to said first upright position comprising an elongated float tie strut having an inner end and an outer end, said inner end being pivotally connected to said first elongated lower folding strut intermediate its opposite ends, said outer end being pivotally connected to said first stabilizing float.

2. A multi-hull boat as recited in claim 1 further comprising a second elongated connecting beam spaced aft of said first elongated connecting beam and means for pivotally securing it to said main hull and said first stabilizing float in a manner similar to said first connecting beam.

3. A multi-hull boat comprising:

an elongated main hull having lateral sides and a longitudinally extending axis;

an elongated first stabilizing float having a top surface, an inner lateral side, and a longitudinally extending axis;

the longitudinal axis of said first float is laterally spaced from the longitudinal axis of said center hull and they are oriented substantially parallel to each other;

a first elongated connecting beam having an inner end and an outer end, said first connecting beam being a substantially rigid unbendable structure;

the outer end of said first connecting beam being pivotally connected to said first stabilizing float;

a first elongated upper folding strut having an inner end and an outer end;

the inner end of said first upper folding strut being pivotally connected to said main hull and its outer end being pivotally connected to said first connecting beam at a predetermined point intermediate its opposite ends;

a first elongated lower folding strut having an inner end and an outer end, the inner end of said first lower folding strut being pivotally connected to one of the lateral sides of said main hull and its outer end being pivotally connected to said first connecting beam at a predetermined point intermediate its opposite ends;

said upper and lower folding struts functioning to allow said first stabilizing float to be positioned on the water with said first connecting beam in a substantially horizontal orientation and also allow said first connecting beam to be retracted to a first upright position to be used when trailering or docking said multi-hull boat; and the top surface of said first stabilizing float having a convex curvature that mates with a concave curvature on the outer end of said first connecting beam to provide a positive locked position when said first connecting beam is in its deployed substantially horizontal orientation.

4. A multi-hull boat comprising;

an elongated main hull having lateral sides and a longitudinally extending axis;

an elongated first stabilizing float having a top surface, an inner lateral side, and a longitudinally extending axis;

the longitudinal axis of said first float is laterally spaced from the longitudinal axis of said center hull and they are oriented substantially parallel to each other;

a first elongated connecting beam having an inner end and an outer end, said first connecting beam being a substantially rigid unbendable structure;

the outer end of said first connecting beam being pivotally connected to said first stabilizing float about a substantially horizontal axis that is oriented substantially parallel to the longitudinal axis of said center hull;

a first elongated upper folding strut having a constant length and having an inner end and an outer end;

the inner end of said first upper folding strut being pivotally connected to said main hull and its outer end being pivotally connected to said connecting beam at a predetermined point intermediate its opposite ends;

a first elongated lower folding strut having an inner end and an outer end, the inner end of said first lower folding strut being pivotally connected to one of the lateral sides of said main hull and its outer end being pivotally connected to said first connecting beam at a predetermined point intermediate its opposite ends;

said upper and lower folding struts functioning to allow said first stabilizing float to be positioned on the water with said first connecting beam in a substantially horizontal orientation and also allow said first connecting beam to be retracted to a first upright position to be used when trailering or docking said multi-hull boat; and means for pulling the inner lateral surface of said first stabilizing float toward said main hull when said first connecting beam is retracted to said first upright position.

5. A multi-hull boat as recited in claim 4 further comprising means on the inner end of said first connecting beam for positively receiving a stop member on said main hull when said first connecting beam member is deployed in its substantially horizontal orientation.

* * * * *